US006612777B2

(12) United States Patent
Maestro

(10) Patent No.: US 6,612,777 B2
(45) Date of Patent: Sep. 2, 2003

(54) STORMWATER DISPENSING CHAMBER

(76) Inventor: Robert M. Maestro, 12301 Beechnut Ct., Woodbridge, VA (US) 22192-2002

( * ) Notice: Subject to any disclaimer, the term of this patent is extended or adjusted under 35 U.S.C. 154(b) by 0 days.

(21) Appl. No.: 09/836,595

(22) Filed: Apr. 18, 2001

(65) Prior Publication Data

US 2002/0025226 A1 Feb. 28, 2002

Related U.S. Application Data

(63) Continuation-in-part of application No. 09/645,269, filed on Aug. 25, 2000, now Pat. No. 6,361,248.

(51) Int. Cl.[7] ..... E02B 13/00; E02B 11/00
(52) U.S. Cl. ..... 405/49; 405/48; 405/46
(58) Field of Search ..... 405/39–49, 36, 405/52–53; 210/170, 747, 532.1; 138/105, 121, 173

(56) References Cited

U.S. PATENT DOCUMENTS

| | | | | | |
|---|---|---|---|---|---|
| 4,246,936 | A | * | 1/1981 | Luz et al. | 138/103 |
| 4,523,613 | A | * | 6/1985 | Fouss et al. | 138/121 |
| 4,759,661 | A | | 7/1988 | Nichols et al. | |
| 4,824,287 | A | * | 4/1989 | Tracy | 405/36 |
| 5,017,041 | A | | 5/1991 | Nichols | |
| 5,087,151 | A | | 2/1992 | DiTullio | |
| 5,129,758 | A | | 7/1992 | Lindstrom | |
| 5,156,488 | A | | 10/1992 | Nichols | |
| 5,336,017 | A | | 8/1994 | Nichols | |
| 5,401,116 | A | | 3/1995 | Nichols | |
| 5,401,459 | A | | 3/1995 | Nichols et al. | |
| 5,419,838 | A | | 5/1995 | DiTullio | |
| 5,441,363 | A | | 8/1995 | Gray | |
| 5,511,903 | A | * | 4/1996 | Nichols et al. | 405/43 |
| 5,556,231 | A | | 9/1996 | Sidaway et al. | |
| 5,588,778 | A | * | 12/1996 | Nichols et al. | 405/48 |
| 5,890,837 | A | * | 4/1999 | Wells | 405/43 |
| 5,890,838 | A | | 4/1999 | Moore, Jr. et al. | |
| 6,076,993 | A | * | 6/2000 | Gray | 405/43 |
| 6,350,374 | B1 | * | 2/2002 | Stever et al. | 210/170 |
| 2002/0044833 | A1 | * | 4/2002 | Kruger et al. | 405/43 |

OTHER PUBLICATIONS

Cultec, Inc. "Side Inlet Detail", brochure page, undated.*

* cited by examiner

*Primary Examiner*—Heather Shackelford
*Assistant Examiner*—Sunil Singh
(74) *Attorney, Agent, or Firm*—Norman Rainer

(57) ABSTRACT

A chamber of elongated arch-shaped configuration for receiving and dispersing stormwater underground is provided with side portals which receive horizontally disposed infeed conduits that deliver stormwater to the chamber. The positioning and function of the side portals, in conjunction with other design features of the chamber, cause suspended matter in the stormwater to accumulate at the exit end of the chamber, thereby facilitating clean-out of the chamber.

6 Claims, 6 Drawing Sheets

STORMWATER DISPENSING CHAMBER

RELATED APPLICATIONS

This Application is a Continuation-in-part of U.S. patent application Ser. No. 09/645,269, filed Aug. 25, 2000, now U.S. Pat. No. 6,361,248, issued Mar. 26, 2002.

BACKGROUND OF THE INVENTION

1. Field of the Invention

The present invention relates to the conveyance, storage and disposal of stormwater runoff, and more particularly concerns chambers which facilitate the infiltration of water into underlying substrate and minimize sediment maintenance requirements.

2. Description of the Prior Art

Culverts, catch basins, and storm sewers are the common practices for collecting and conveying stormwater runoff. In some instances such water is discharged directly into the nearest available water body despite the potentially adverse environmental effects of such action. In some other instances, stormwater management facilities are constructed to help manage the quantity and quality of the stormwater. Wet or dry retention or detention basins/ponds represent the most common structural approach to stormwater management. Although more environmentally sound then direct discharge into an existing water body, such stormwater management approaches preclude other uses of the land. This is of particular importance where land values are high and/or space is limited. The open ponds may also be undesirable in locations near airports because of birds attracted by the pond, or in locations where health, liability or aesthetic considerations make them undesirable. Even the use of "dry" detention basins frequently results in the same types of problems associated with wet ponds. Without proper maintenance, dry detention basins frequently transform into wet ponds.

Underground systems have also been developed to help manage stormwater and/or sewage system effluent. Those systems most commonly used include rows of large diameter perforated or unperforated pipe with a relatively small pipe protruding at the upper end of the pipe to retard flow for sediment deposition; infiltration trenches, which are basically excavations filled with stone, which may or may not be fed via drain pipes; and sand filters—typically large, partitioned concrete "boxes" with an initial compartment for sediment deposition and a following compartment with sand and under-drains for stormwater filtration. Although in limited use for approximately 10 years, the use of plastic arch-shaped, open bottom stormwater chambers for stormwater management is a relatively novel approach. Plastic stormwater chambers are highly preferable to other types of underground stormwater management systems for several reasons: they are typically less expensive; they are more maintenance "friendly"; have a longer effective life; and unlike some other types of underground stormwater management facilities, can be located under paved areas. However, all current underground stormwater management systems are limited by the amount of area available for their installation.

In a typical installation, elongated hollow plastic chambers are emplaced in the ground to form a leaching field for receiving such waters and dispensing them into the surrounding earth. Such chambers have a central cavity for receiving inflow water. An open bottom, and apertures in the sides of the chamber provide the means whereby the water is allowed to exit the central cavity and disperse into the surrounding earth. The chambers are usually attached endwise to form long rows extending in side-by-side juxtaposition in a multi-row array that constitutes a leaching field. The stormwater is generally conducted to the array of rows by a large diameter header manifold pipe that runs orthogonally to the rows closely adjacent one extremity thereof, similar to an underground pipe storage system. Short feeder conduits convey the water from the header pipe to the end wall of the first chamber of each row. The assemblage of chambers is generally engulfed in coarse backfill such as gravel or rock and overlying compacted soil to the surface or to a paved cover surface. The resultant installation may be used as a parking lot, roadway, sports field or for other uses.

The header pipe or manifold system is typically comprised of a 24 inch diameter or larger high density polyethylene (HDPE) pipe with HDPE tees, within which 12 inch lateral pipes are inserted to feed each chamber row. It is not unusual for such a header pipe (manifold) system to be comprised of over 200 feet of HDPE pipe and 50 HDPE tees. A header pipe system of this type becomes very expensive and could easily add over $5,000 to the cost of the stormwater management system and require an additional approximate 2,000 square feet of area for installation.

In order to sustain the considerable downward forces imposed by the surrounding backfill and overhead vehicular traffic, the chambers are generally of arch-shaped configuration having a corrugated construction. The corrugations consist of a continuous sequence of ridges or peaks separated by valleys. The peaks and valleys are connected by web portions disposed in planes substantially orthogonal to the axis of elongation of the chamber.

Examples of such leaching chambers are disclosed in U.S. Pat. Nos. 5,017,041; 5,156,488; 5,336,017; 5,401,116; 5,441,363 and 5,556,231. Such leaching chambers generally have a geometrical configuration which permits nesting, thereby facilitating shipping and storage.

Stormwater may carry considerable amounts of suspended particulate material, commonly referred to as Total Suspended Solids (TSS), which eventually settles out as sediment. The accumulation of such sediment adversely affects the storage capacity of stormwater management facilities, decreasing their effective life. The effective life of such facilities can be extended with a maintenance program for sediment removal.

Unfortunately, the maintenance of stormwater management systems is typically neglected, and occurs when the system fails or sediment accumulates to a point where flooding occurs because of diminished storage capacity of the system. This problem has become so serious that a few municipalities have recently imposed a stormwater maintenance "fee" on property owners to help pay for private-sector stormwater facility maintenance. The "fee" has not been sufficient in many cases to provide adequate maintenance.

Unlike stormwater wet and dry ponds, which are readily observable and accessible, removal of sediment from underground stormwater management facilities has historically been inherently more inconvenient and costly, resulting in resistance to their use by some municipalities. Some types of underground stormwater management facilities even have to be replaced in order to remove accumulated sediment.

Although leaching fields produced in the aforesaid manner from rows of chambers generally perform in satisfactory manner, their installation is made difficult or impossible when it is required that a header supply pipe with attendant lateral feed pipes (i.e. manifold system) approach the field at one extremity of the rows. Such requirement generally dictates a specialized configuration of excavation required for installing the header supply pipe system in proper relationship to the leaching field and source of the incoming stormwater. A header pipe system could also add significant cost. Not only is extensive excavation required, but extensive amounts of piping may be required for circuitous routings between inlet structures and the header pipe system. The additional land required to access the leaching field may be occupied by buildings or may, for other reasons, be unavailable for excavation. For example, gasoline stations have considerable underground facilities which severely restrict placement of an underground stormwater system. Site limitations of this nature may even preclude the use of underground stormwater systems requiring a header pipe system.

It is accordingly an object of the present invention to provide a stormwater dispensing chamber for producing a leaching field which is more readily accessible to incoming stormwater.

It is another object of this invention to provide a stormwater dispensing chamber as in the foregoing object which facilitates the removal of sediment.

It is a further object of the present invention to provide a stormwater dispensing chamber of the aforesaid nature having sufficient strength to withstand the forces of overlying substrate and inflowing water.

It is yet another object of this invention to provide a stormwater dispensing chamber of the aforesaid nature which provides greater flexibility in accommodating hydrologic and engineering factors in producing a leaching field.

These objects and other objects and advantages of the invention will be apparent from the following description.

SUMMARY OF THE INVENTION

The above and other beneficial objects and advantages are accomplished in accordance with the present invention by an improved water dispensing chamber fabricated as a monolithic plastic structure comprising a wall elongated upon a straight axis between inlet and exit ends and having the cross-sectional shape of an arch with upwardly directed peak, said wall defining an open bottom bounded by lowermost spaced apart parallel edges of said wall, said wall further having a multiplicity of alternating peaks and valleys disposed in planes orthogonal to said axis. Interconnecting means located adjacent each end as integral features of said wall allow end-to-end joinder of contiguous chambers to form rows which permit communicating passage of water. In the improved dispensing chamber of this invention, inlet portal means are provided in said arch shaped wall in at least two sites on laterally opposite sides of said axis.

In a preferred embodiment of the improved chamber of the present invention, the exit end of the chamber is provided with flow-impeding means such as an apertured panel extending transversely with respect to said axis between opposite sides of said wall.

BRIEF DESCRIPTION OF THE DRAWING

For a fuller understanding of the nature and objects of the invention, reference should be made to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
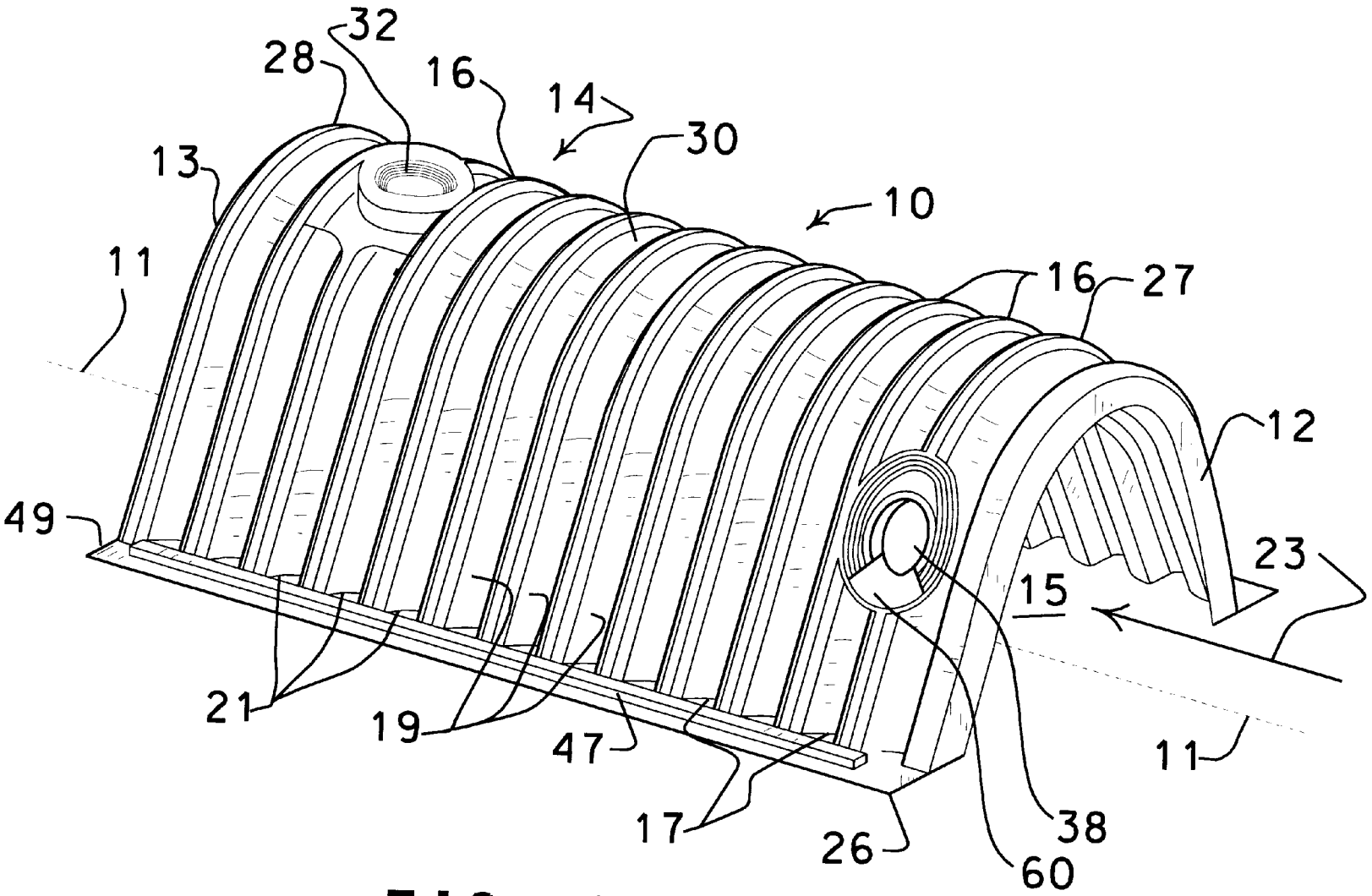
FIG. 1 is a front, side and top perspective view of an embodiment of the water dispensing chamber of the present invention.

Referring now to FIGS. 1–6, an embodiment of the chamber 10 of the present invention is shown comprised of a monolithic plastic structure elongated upon straight axis 11 between inlet and exit ends 12 and 13, respectively.

Chamber 10 is comprised of a wall 14 having an arch shape cross section with an upwardly directed peak 50, and opposed lowermost spaced apart parallel edges 49 which define an open bottom 15. Wall 14 has a multiplicity of alternating peaks and valleys 16 and 17, respectively, running along the arch shape in planes orthogonal to said axis, thereby causing wall 14 to have a corrugated appearance. Adjacent peaks and valleys are connected by facing upstream and downstream web panels 18 and 19, respectively, embracing each valley 17. Said upstream web panel is closer to said inlet end than the associated facing downstream web panel.

Figure 2:
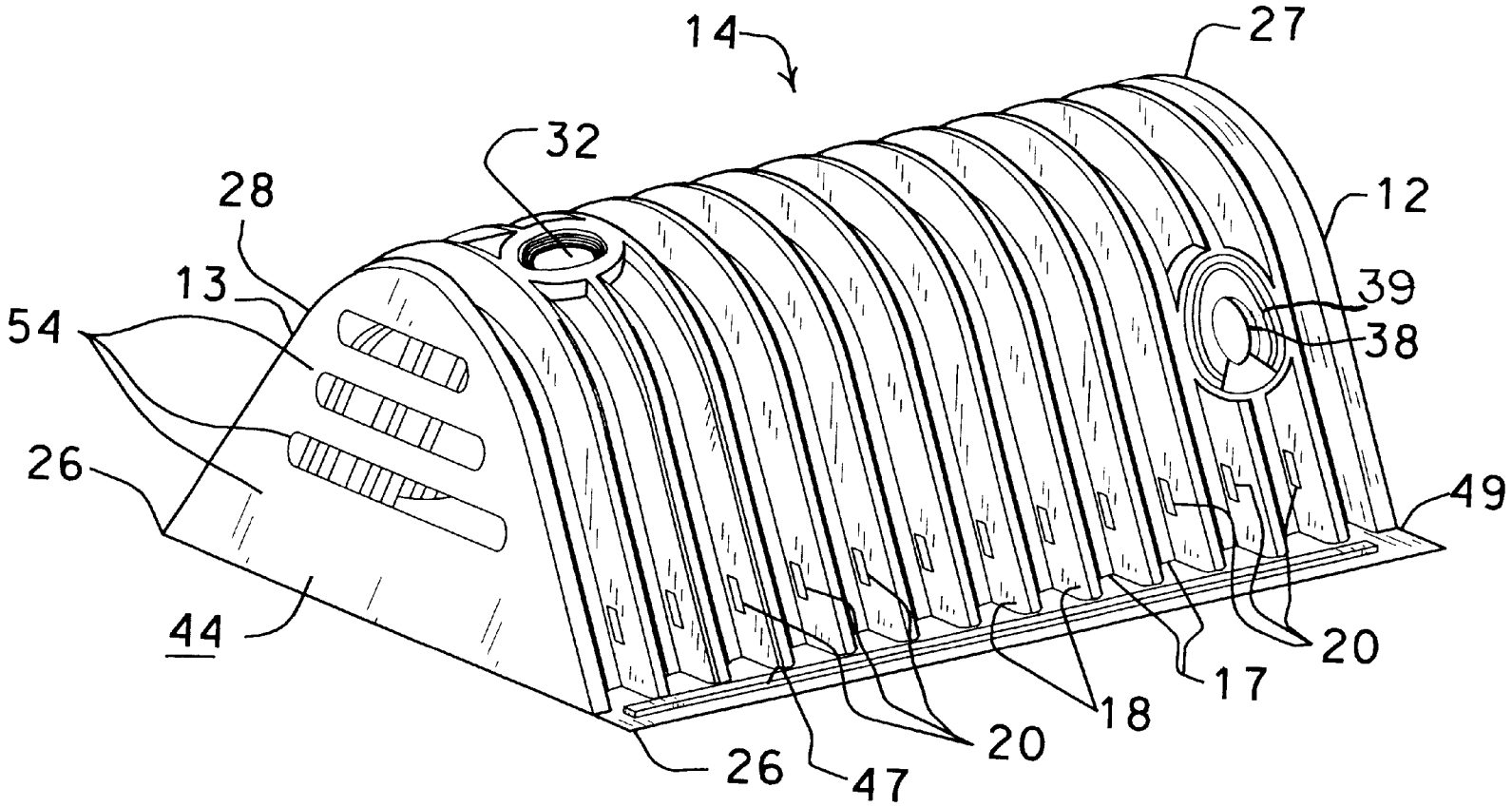
FIG. 2 is a rear, side and top perspective view of the chamber of FIG. 1.
Figure 3:
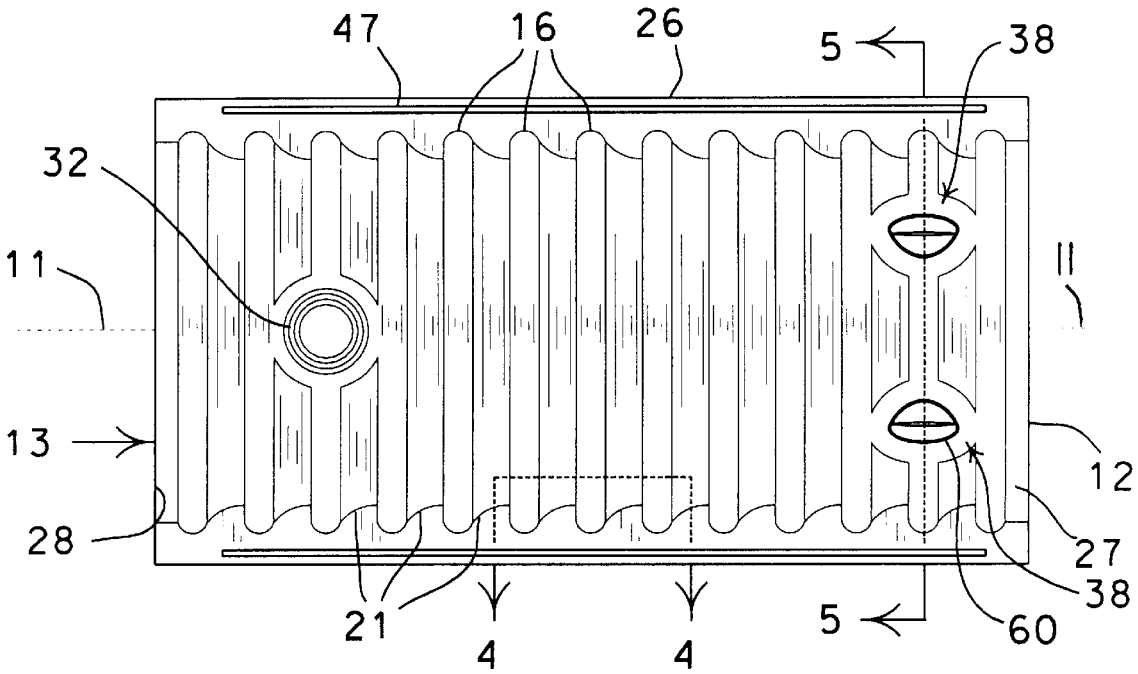
FIG. 3 is a top view of the chamber of FIG. 1.
Figure 4:
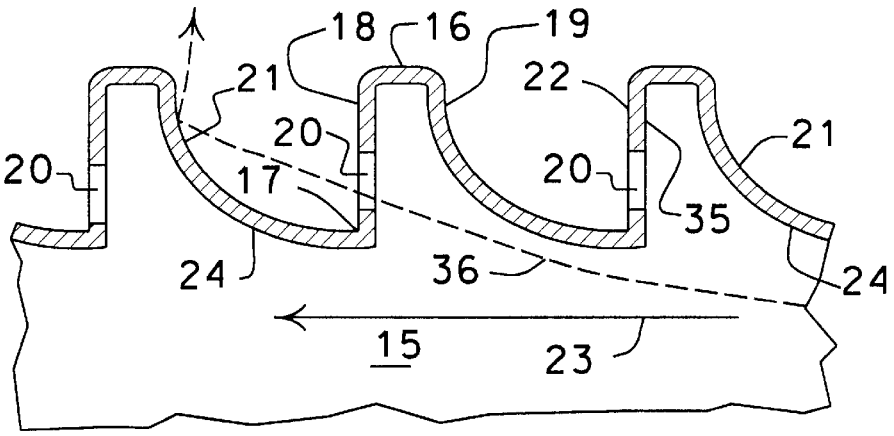
FIG. 4 is an enlarged fragmentary sectional view taken in the direction of the arrows upon the line 4—4 of FIG. 3.

As best shown in FIGS. 2 and 4, apertures 20 may be present, communicating between the interior and exterior surfaces, 35 and 22, respectively of wall 14. Said apertures are disposed in upstream web panels 18. The apertures are preferably of elongated shape, having a rectangular, elliptical or other configuration characterized in being symmetrical with respect to a centered axis of elongation.

Where the aforesaid apertures 20 are present, said downstream web panels are smoothly integrated with the corresponding valley to form a curved impingement surface 21 which is concave with respect to the immediately preceding upstream peak 16. The effect of impingement surface 21 is to receive a stream of water emergent from associated apertures 20, and deflect said stream outwardly from the chamber, said stream being represented by the broken line arrowed path 36 in FIG. 4. As further illustrated in FIG. 4, said stream of emergent water is substantially tangentially derived from the chamber's main flow of water, represented by solid arrowed line 23. It is important to note that the interiorly directed convex face 24 of impingement surface 21 serves to attract and hold emergent stream 36 by virtue of the well known Coanda principle of fluid dynamics. Such factors cause emergent stream 36 to have a velocity comparable to the velocity of the main flow 23, thereby facilitating the removal of some suspended solids from the chamber.

The chambers of the present invention are fabricated preferably of high density polyethylene by way of thermal vacuum forming or gas assisted injection molding techniques, generally in accord with the technology described in U.S. Pat. Nos. 5,401,459; 5,087,151; 4,247,515; 4,234,642; 4,136,220 and 4,101,617. The disclosures of the foregoing patents are hereby incorporated by reference. Thus, during molding, the plastic is configured to form a chamber having outwardly directed hollow ribs or corrugations. The chamber may however be fabricated in alternate ways. For example, it may be fabricated of structural foam, or made by conventional injection molding, etc. The wall thickness of the chamber may be uniform throughout or varied to achieve structural reinforcement in specific areas.

The chamber preferably has opposed axially elongated base panels 26 integral with the lowermost edge extremities 49 of wall 14. Said base panels support the chamber, discouraging its descent into the underlying substrate. Base panels 26 also enhance the rigidity of the chamber and prevent divergent lateral movement of said lowermost edge extremities, particularly at the site of joinder of the terminal ends of consecutive chambers. An upraised ridge 47 may extend the length of the base panels to impart further rigidity to the chamber and particularly to prevent bowing.

The terminal or first rib or corrugation 27 adjacent inlet end 12 may be slightly larger than the multitude of ribs, and terminal rib 28 adjacent exit end 13 is slightly smaller than the multitude of ribs. Such configuration of the terminal ribs facilitates end-to-end joinder of successive chambers wherein vertical lowering of a chamber automatically causes the larger rib of one chamber to embrace the smaller rib of the next successive chamber. Other interactive means may be associated with said terminal ribs to prevent divergent lateral and/or longitudinal movement of edge extremities 49 of the chamber wall.

Side inlet portal means 38 are disposed in wall 14 adjacent inlet end 12 and centered at a site between 10% and 20% of the length of the chamber, and at an elevation between 40% and 70% of the distance between peak 50 and lowermost edge extremities 49. Such critical placement of said portal means 38 has been found to minimize any diminution of compressive strength of the chamber, and facilitate sediment removal. Water flowing into the chamber through portal means 38 impinges upon the opposite interior surface of wall 14. This permits accumulation of sediment behind transverse panel 44 for easy removal through top portal 32. Said portal means 38 may be either a circular or elliptical aperture, or an indentation or other indicia which defines a perimeter for the cutting of the plastic wall so as to create a circular or elliptical aperture. At least two of said portal means are present in laterally opposite disposition with respect to axis 11. In the illustrated preferred embodiment, portal means 38 is a circular aperture disposed in a vertical plane, and not in the inclined plane of wall 14. Such configuration is achieved by way of a corrugated recess 39 which not only permits vertical orientation of the aperture but strengthens the adjacent wall structure and forms a shelf 60 for supporting an inserted pipe.

Figure 5:
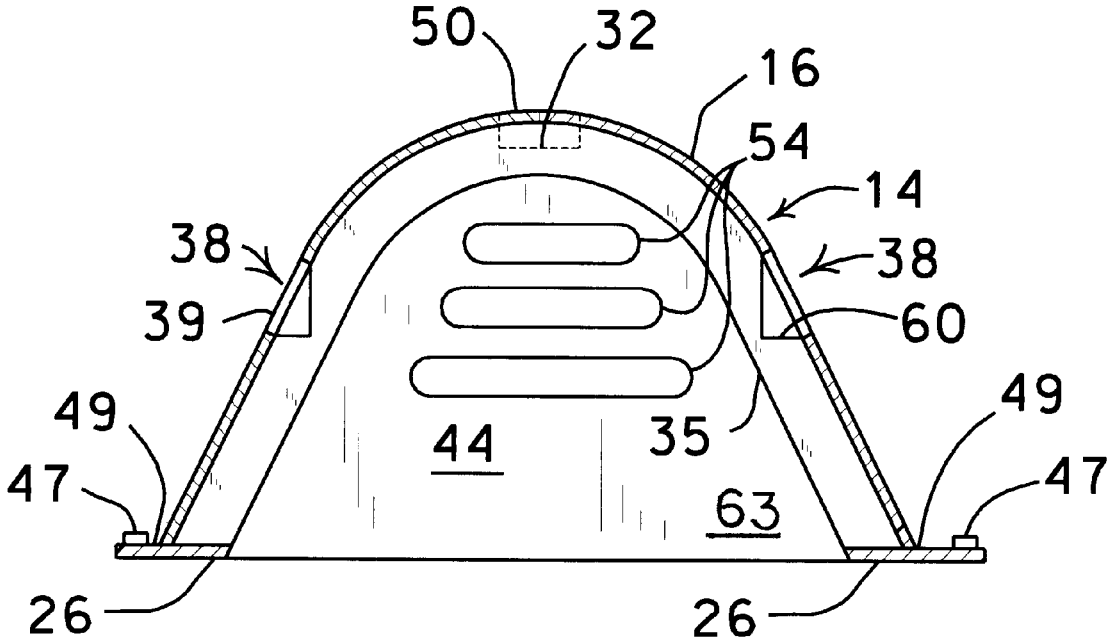
FIG. 5 is a vertical sectional view taken in the direction of the arrows upon the line 5—5 of FIG. 3.
Figure 6:
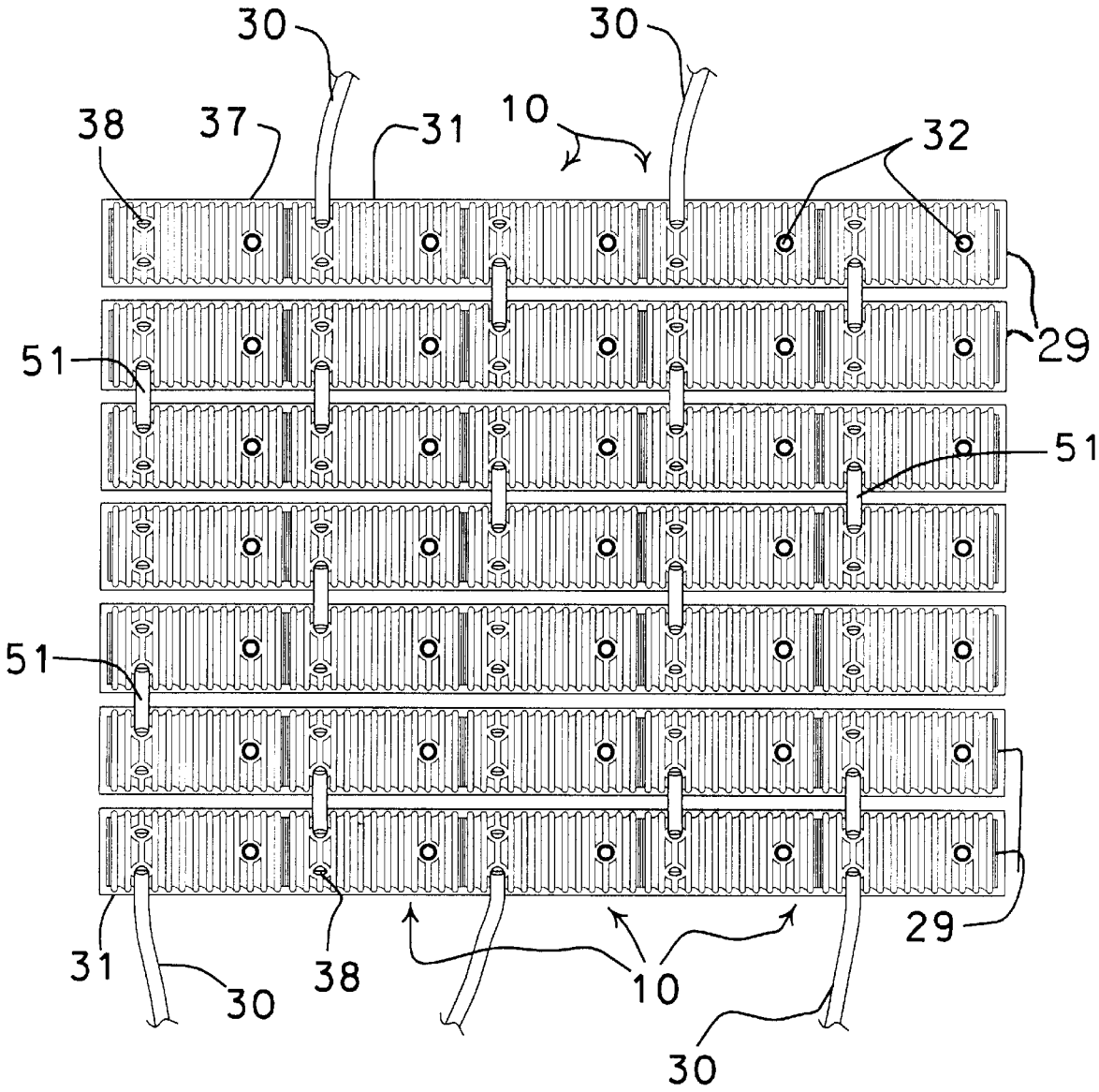
FIG. 6 is a schematic plan view of a multitude of chambers of FIG. 1 shown functionally emplaced to produce a drainage field.

In a typical installation, as shown in FIG. 6, a multitude of the chambers of the present invention are joined endwise to form long rows 29. A multitude of such rows are in side-by-side juxtaposition, resting upon a crushed rock substrate. Feeder conduits 30 deliver the water to the drainage field, conveying the water directly to portals 38 in the sides of the chambers of the outermost rows 31. Within each row, the first chamber 37 has an upstream or inlet extremity which is closed by an end wall. The successive chambers in the row, subsequent to the first chamber, have a completely open inlet end or upstream extremity. The downstream extremity or exit end 13 of each chamber has flow impeding means in the form of transverse panel 44, as best shown in FIG. 5, having a lower impervious portion 63 and an upper portion having slotted apertures 54. Said transverse panel functions to reduce the velocity of water flow, thereby causing sediment to accumulate in the area of exit end 13 of the chamber, and directly below top portal 32. This permits visual observation of the sediment, and removal thereof by vacuum equipment. Such features, not provided by prior art chambers, facilitate scheduled sediment removal.

In alternative embodiments, the flow impeding means may have a different pattern of apertures. The last chamber in the row has an exit end wall which is closed except perhaps for an opening to accommodate a discharge conduit. In alternative embodiments, feeder conduits 30 may convey water directly to portals 38 in chambers of the inner rows, or to a single row of chambers.

In a typical installation of chambers of the present invention to form a leaching field, as shown in FIG. 6, side portals 38 provide interconnective means for conveying water between chamber rows. As water begins to flow out of a chamber through portal 38 into a chamber of an adjoining row, the velocity of flow is decreased significantly as the direction of flow changes in an approximate 90% angle from its flow along the main axis 11. The decrease in velocity of flow results in deposition of suspended solids in the initial chamber.

The cumulative and synergistic effect of said portal means 38 and transverse panel 44 are critical to the effectiveness of sediment management. Said transverse panel 44 of a chamber and the immediate "up stream" chamber cause deposition of suspended materials prior to the water flow elevating to the opening of side portal 38. The preponderance of sediment deposition occurs at transverse panel 44 of the instant and immediate "upstream" chamber. Only during infrequent major storm events would the water level in the chambers approach the elevation of side portal 38. When the elevation of said portal 38 is reached, most of the sediment is still deposited adjacent transverse panel 44 as the result of the eddy effects created by flow against said transverse panel. Additionally, it is well documented that 80% to 90% of sediment and other pollutants in stormwater runoff occur during the "first flush" which is defined by most people knowledgeable in the art as the first ½" of rainfall. It would be unlikely that a stormwater chamber system similar to that of the instant application would be designed where the water elevation within the chambers from a ½" rainfall would exceed the height of the bottom closed portion of transverse panel 44.

In situations where the elevation of the closed portion of transverse panel 44 is exceeded, the upper slotted face of transverse panel 44 is designed to provide flow into adjacent "down stream" chambers while concurrently creating minor eddy effects to help remove any residual amounts of sediment being transported at the higher flow elevations. The effectiveness of side portal 38 for sediment deposition is thereby highly enhanced by the function of transverse panel 44, as the transported sediment load becomes minimal at an elevation of side portal 38, resulting in the transport of insignificant amounts of sediment into adjacent chamber rows.

Said sediment deposition features and functions result in the vast majority of sediment concentrating in those rows of a chamber system, as depicted in FIG. 6, that receive the inflow water, and therefore where it can be managed with more predictability and efficiency than with existing art in which sediment is deposited with no predictability of location or concentration throughout the system of chambers.

Figure 7:
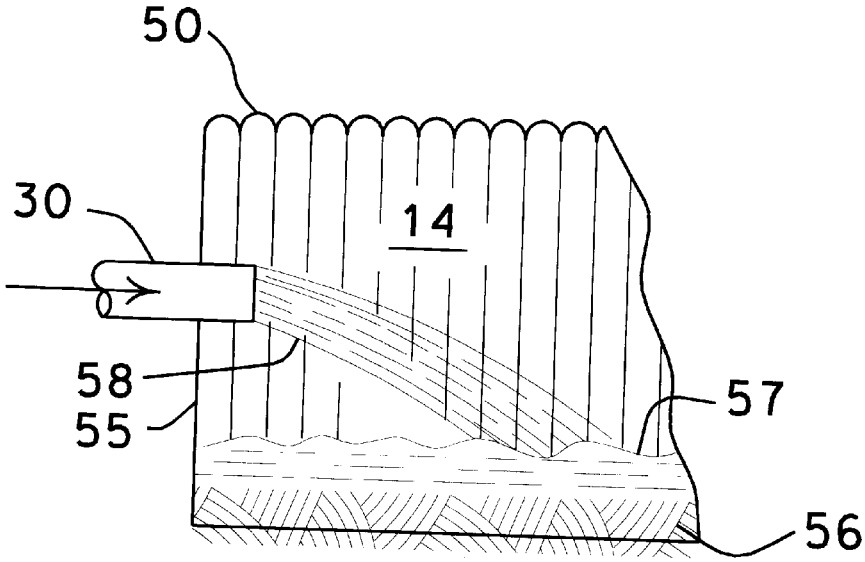
FIG. 7 (PRIOR ART)
FIG. 7 is a schematic fragmentary vertical sectional view of a chamber of the prior art.
Figure 8:
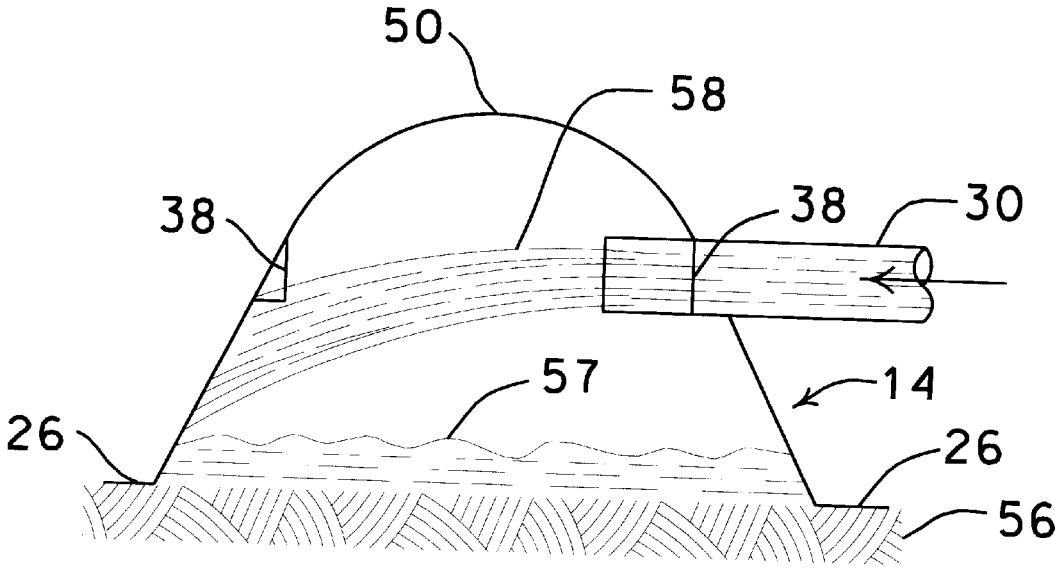
FIG. 8 is a schematic fragmentary vertical sectional view of the chamber of FIG. 1.

Interconnecting conduits 51 may extend between chambers of adjacent rows, communicating between the side portals 38 of said chambers. By virtue of such manner of underground installation of the chambers of the present invention, the field of chambers is readily accessible from several directions, thereby permitting options of convenience and reduced installation costs with respect to the routing of the influent water flow. Elimination of a header pipe feeder system of the prior art also allows the leaching field to occupy less total area. It should also be noted that the numerous side portal infeed sites can be used to divide the total flow of water received by the drainage field. Accordingly, a high degree of flexibility is available for dispersing inlet flow to meet a wide range of hydrologic and design requirements. It has been found that a further advantage of side portal entry of water, in comparison to water entry through an end wall header pipe system is that erosion and potential undermining of the stone base and underlying soil is reduced which in turn reduces the possibility of subsidence of the overlying surface. This principle is best illustrated in FIGS. 7 and 8. In the operation of the prior art chamber of FIG. 7 wherein inflow water enters the upstream end wall 55, the infeed water stream 58 falls directly onto the gravel bed 56, which may or may not be covered by a shallow layer of resident water 57. In the operation of the chamber of this invention, as shown in FIG. 8, the infeed water stream 58 impinges upon the opposite wall of the chamber, where it is dispersed as it falls to the gravel bed below, thereby dissipating its erosive energy. Where the opposite portal 38 is open and fitted with a pipe, some of stream 58 may enter said opposite portal, thereby serving to further dissipate influent water throughout the leaching field.

Typical chambers of this invention may have a length of 6–12 feet measured between inlet and exit ends and a height of 5–50 inches measured between base panel 26 and the peak 50 of the arched wall. The width of the chamber, measured transversely to axis 11 in the plane of base panel 26, may range between 6 and 80 inches, including the width of said base panels.

Top portal means 32 may be present to receive inlet stormwater and facilitate inspection and clean out. Portal means 32 permits joinder with a vertical access conduit communicating with a manhole located at ground level above the chamber. Such arrangement facilitates removal of accumulated sediment by use of vacuum truck equipment. Portal 32 is preferably located adjacent exit end 13 within 10% to 20% of the length of the chamber so as to provide easier access to sediment concentrated adjacent transverse panel 44. Top portal means 32 may also be employed for the insertion and removal of absorbents capable of removing dissolved pollutants. Suitable absorbents are those unaffected by suspended material and which provide little impedance to fluid flow. An example of such absorbent material, as disclosed in U.S. Pat. No. 5,597,850, is a sponge material which can be easily confined in a porous enclosure capable of vertical insertion into and removal from the chamber. Said top portal means may be either a circular aperture or indentations to guide installing personnel in cutting a circle of proper diameter for insertion of an interactive conduit. It is important to note that side portal means 38 are positioned at the opposite extremity of the chamber with respect to top portal means 32. Such positioning achieves best functionality of the chamber without diminishing the strength of wall 14. Accordingly, in the exemplified preferred embodiment, top portal means 32 is shown positioned closely adjacent exit end 13 at a site between 10% and 20% of the length of the chamber.

In-ground testing of a precursor design of that described in the instant application demonstrated that improper incorporation of side portals diminished the chamber's structural integrity. It was found that said side portal means 38 should be located at the opposite end of the chamber from top portal means 32 to avoid a concentrated localized reduction in chamber structural integrity, and should be located as close as possible to inlet end 12 in order to benefit from the added strength of the overlapping of terminal ribs of contiguous chambers. The height and width of chamber ribs, as well as the ratio of rib width between the top and bottom of the chamber, were found to be critical to the structural integrity of the chamber. The preferred rib height and width is between 3.0 inches and 4.5 inches, measured at the top of the chamber. The preferable ratio of top of rib to bottom of rib width for maximum strength is between 0.76 and 0.92. The extent of recess of the side portal walls was similarly designed to reflect, as much as possible, the preferred rib height for maximum structural integrity. The precursor cross-sectional parabolic design, although the preferred geometry for maximum strength from downward vertical loadings, was found from the in-ground testing of in-vivo conditions to provide insufficient structural integrity from angularly applied loadings that occurred to the bottom one-third of the chamber from heavy construction vehicles perpendicularly traversing installed chambers. In the preferred embodiment, the cross-sectional geometry is between a parabolic arch and a semicircle.

The assemblage of said rows of chambers is covered with crushed rock or coarse gravel to the top of the chambers, covered with filter fabric of specified characteristics, and with soil or additional rock or gravel to the surface or to a stone subbase for a paved surface to complete the leaching field installation.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. In a plastic storm water dispensing chamber comprising a wall elongated upon a straight axis between inlet and exit ends and having the cross-sectional shape of an arch with upwardly directed peak and opposed lowermost extremities, said wall defining an open bottom of said chamber and further having a multiplicity of ribs comprised of alternating peaks and valleys disposed in planes orthogonal to said axis, the improvement comprising side portal means of circular contour disposed in a vertical plane for receiving in horizontal disposition infeed conduits that deliver water to said chamber, said side portal means provided in at least two sites on laterally opposed sides of said axis and having an associated corrugated recess which serves to strengthen said wall in the vicinity of said portal means.

2. The improved chamber of claim 1 wherein said side portal means are adjacent said inlet end.

3. The improved chamber of claim 1 wherein said side portal means are positioned at an elevation in said wall between 40% and 70% of the distance between said peak and lowermost extremities.

4. The improved chamber of claim 1 wherein said multiplicity of ribs includes a first rib adjacent said inlet end and terminal rib adjacent said exit end, said first and terminal ribs being configured so as to achieve interlocking of contiguous identical chambers.

5. The improved chamber of claim 1 further provided with top portal means positioned in the peak of said wall adjacent said exit end.

6. A leaching field comprising an assemblage of plastic stormwater dispensing chambers, each chamber comprising a wall elongated upon a straight axis between inlet and exit ends and having the cross-sectional shape of an arch with upwardly directed peak and opposed lowermost extremities, said wall defining an open bottom of said chamber and having side portal means of circular contour disposed in a vertical plane for receiving in horizontal disposition infeed conduits that deliver water to said chamber, said side portal means provided in at least two sites on laterally opposite sides of said axis, said assemblage having closely adjacent parallel rows comprised of said chambers interconnected such that the exit end of one chamber joins the inlet end of the next consecutive chamber, and interconnecting conduits that communicate between the side portal means of chambers in said adjacent rows.

* * * * *